US006240734B1

(12) United States Patent
Ferrier et al.

(10) Patent No.: US 6,240,734 B1
(45) Date of Patent: Jun. 5, 2001

(54) ICE BANK CHILLERS

(75) Inventors: Derek Ferrier, Hampshire; Jason Futter, Southampton, both of (GB)

(73) Assignee: The Electric Motor Company Limited, Totton (GB)

( * ) Notice: Subject to any disclaimer, the term of this patent is extended or adjusted under 35 U.S.C. 154(b) by 0 days.

(21) Appl. No.: 09/404,666

(22) Filed: Sep. 23, 1999

(30) Foreign Application Priority Data

May 27, 1999 (GB) ..... 9912261

(51) Int. Cl.[7] ..... F25C 1/00
(52) U.S. Cl. ..... 62/139; 62/59
(58) Field of Search ..... 62/59, 139

(56) References Cited

U.S. PATENT DOCUMENTS

| | | | |
|---|---|---|---|
| 3,815,879 | | 6/1974 | Mikhailov et al. . |
| 4,193,702 | | 3/1980 | Davis . |
| 4,437,765 | | 3/1984 | Seeger . |
| 4,497,179 | * | 2/1985 | Iwans ..... 62/59 |
| 4,530,803 | | 7/1985 | Kuckens . |
| 5,073,312 | | 12/1991 | Burrows . |
| 5,984,144 | * | 11/1999 | Wyatt ..... 62/59 |

FOREIGN PATENT DOCUMENTS

| | | |
|---|---|---|
| 0744584 | 11/1996 | (EP) . |
| 0866028 | 9/1998 | (EP) . |
| 2446606 | 8/1980 | (FR) . |
| 1437828 | 6/1976 | (GB) . |
| 1541905 | 3/1979 | (GB) . |
| 2307975A | 11/1997 | (GB) . |
| 2323433A | 9/1998 | (GB) . |

* cited by examiner

*Primary Examiner*—Corrine McDermott
*Assistant Examiner*—Mohammad M Ali
(74) *Attorney, Agent, or Firm*—Peter J. Phillips; Cooper & Dunham LLP

(57) ABSTRACT

An ice bank chiller comprises a reservoir, a vertically extending cooling coil adjacent to a side wall of the reservoir, and an agitation pump for agitating water contained in the reservoir, the agitation pump being arranged to cause substantial circulation of the reservoir water adjacent to ice on both the upper and lower regions of the cooling coil in order to promote an even thickness of ice on the cooling coil. The agitation pump comprises an impeller rotatable within a pump housing, the housing being provided with a plurality of circumferentially spaced-apart pump outlets, through which streams of water are directed towards the ice on the upper region of the cooling coil (2).

12 Claims, 7 Drawing Sheets

ICE BANK CHILLERS

Figure 1:
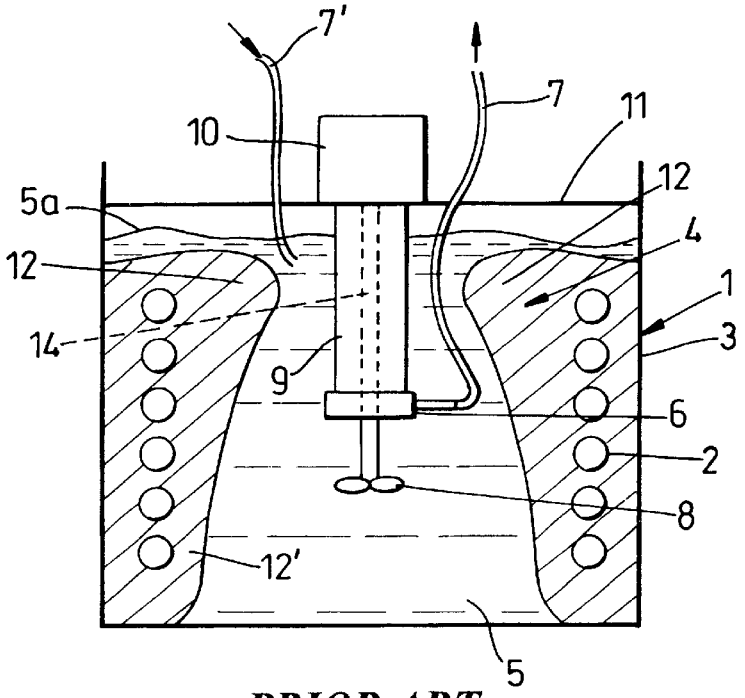
PRIOR ART Fig. 1

The present invention relates to ice bank chillers for supplying chilled water to fluids in pipes, such as beverages, or a beverage component such as a concentrate or diluent, and to a water agitation assembly for use in an ice bank chiller.

Ice bank chillers are well known and comprise a water reservoir incorporating a cooling coil associated with a refrigeration circuit. A layer of ice builds up on the cooling coil to act as a store of cold. A pumped supply of water to be chilled runs through the reservoir and is generally operated intermittently as demand occurs for beverages.

In a known drinks supply system there is provided a bundle of drink carrying tubes that are kept cool by a tube carrying circulating chilled water, which is kept in close proximity to the drink tubes by being enclosed in a jacket, or 'python'. The chilled water is pumped from the reservoir or an ice bank chiller using a single fluid pump driven by an electric motor.

The chilled water in the reservoir is traditionally stirred by an agitator in the form of a paddle on the lower end of the downwardly extending pump/motor shaft. This reduces the thickness of the ice bank on the lower sides of the reservoir, which improves heat transfer between the water in the reservoir and the cooling coils in this area (see FIG. 1), but the ice bank remains thick further up towards the surface.

According to the invention an ice bank chiller comprises a reservoir, vertically distributed cooling means adjacent to a side wall of the reservoir, and agitation means for agitating, in use, water contained in the reservoir, wherein the agitation means is so arranged as, in use, to cause substantial circulation of the reservoir water adjacent to ice on both the upper and lower regions of the cooling means.

By arranging that reservoir water circulates against both the upper and lower parts of the ice bank, the wall thickness of the ice bank can be kept substantially uniform with height so as to avoid reductions in heat transfer due to excessive build-up of ice on the upper part of the cooling means.

The agitation means preferably comprises an agitation pump so arranged as to direct a plurality of streams of water towards the cooling means.

The agitation pump preferably comprises an impeller rotatable within a pump housing, the housing being provided with a plurality of circumferentially spaced-apart pump outlets, the arrangement being such that, in use, on rotation of the impeller in a forward direction, streams of water are directed from said outlets towards the ice on the cooling means.

The agitation pump is preferably arranged to direct said streams of water with a circumferential component of direction, ie the streams of water are directed at an acute angle relative to the radial direction, so as to create a swirling movement in the water that is radially exterior to the agitation pump housing. The swirl of water will help to erode that part of the ice bank that is radially outward of the agitation pump.

The agitation pump housing is preferably provided with a downwardly inclined skirt for directing said streams of water in a downwardly and outwardly direction.

The agitation pump housing preferably is formed with a substantially axial water inlet which preferably is directed downwardly in use. The pump housing may be provided with a downwardly directed tube feeding said inlet, in order to collect water from the lower regions of the reservoir, to promote flows throughout the reservoir.

The agitation assembly may comprise vertically spaced-apart upper and lower agitation means which are conveniently driven by a common drive means, preferably a substantially vertical shaft driven by a motor mounted at or adjacent the top of the reservoir.

Said agitation pump preferably then constitutes said upper agitation means located in the upper part of the reservoir, and said lower agitation means preferably then comprises a rotatable paddle.

The pump for supplying the chilled water may be driven by the same drive means that is arranged to drive the first and second agitation means, and may be positioned vertically between the first and second agitation means.

Figure 2:
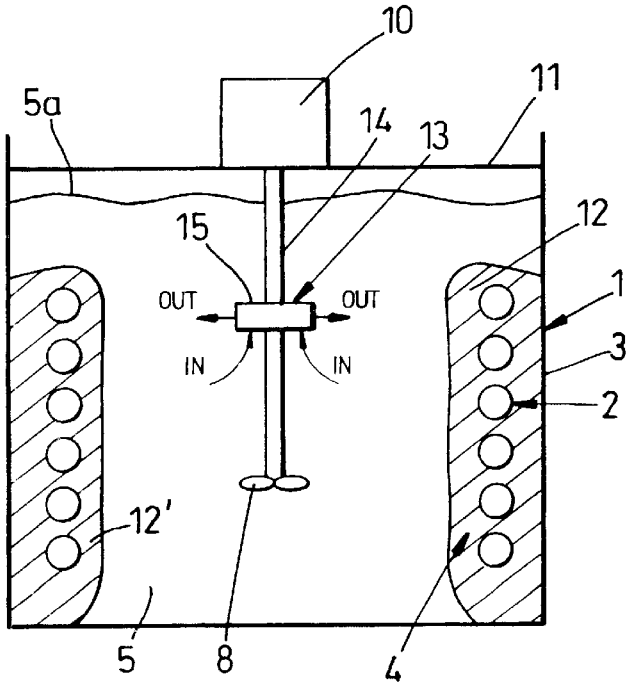
Figure 3:
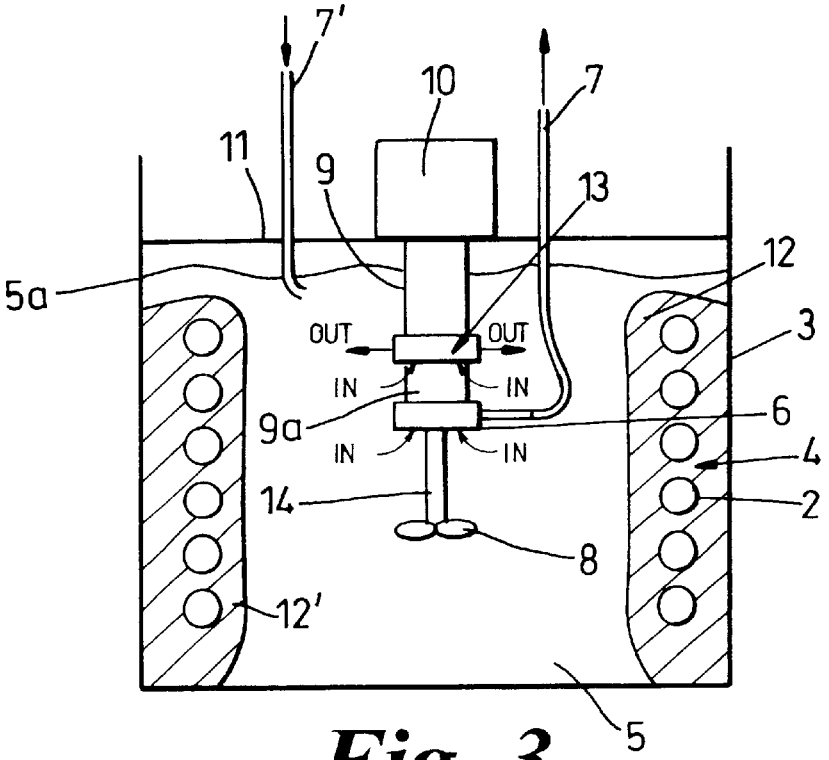
Figure 4:
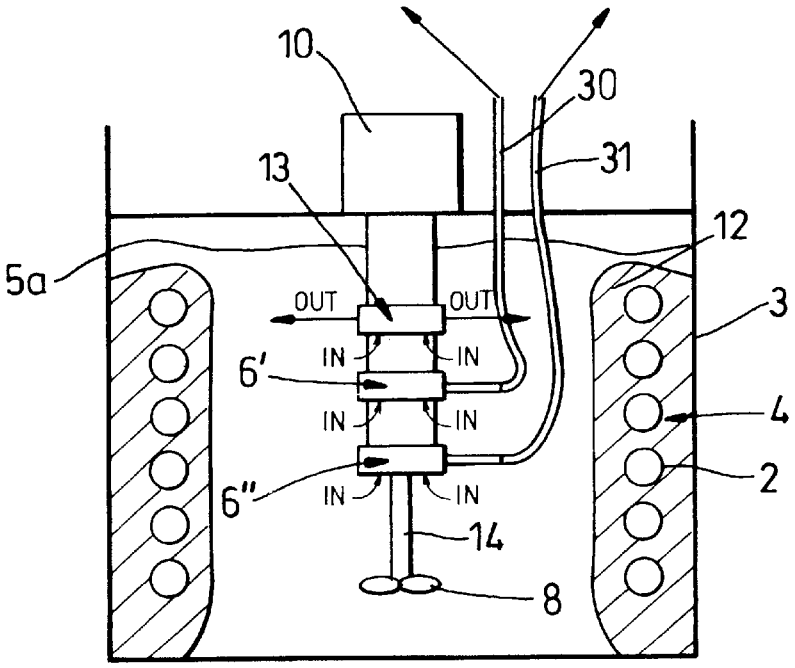
Figure 5:
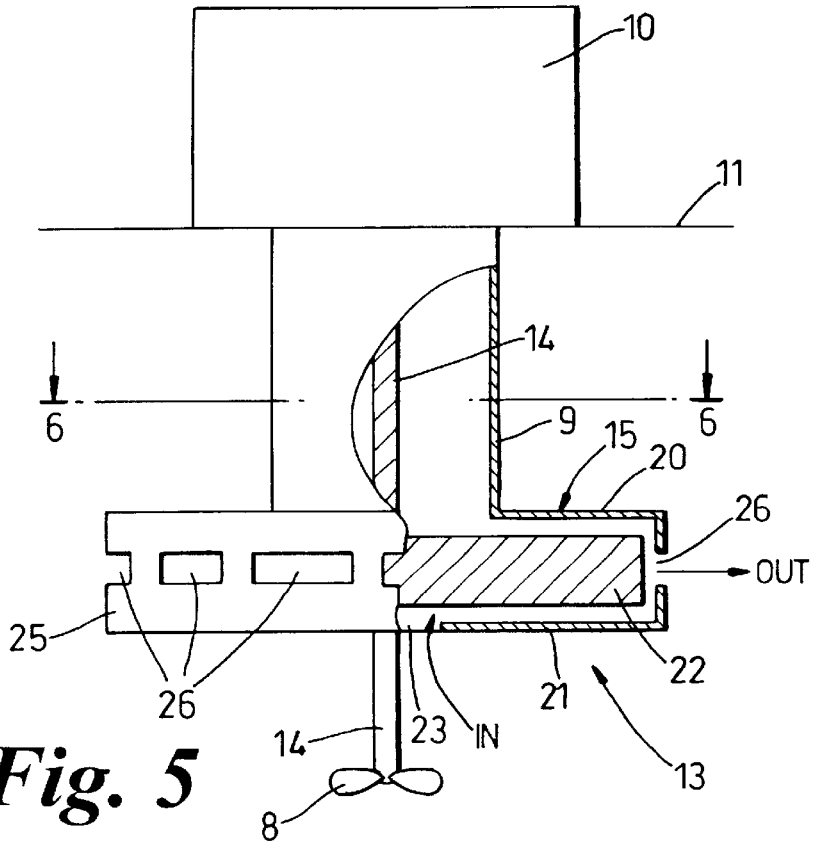
Figure 6:
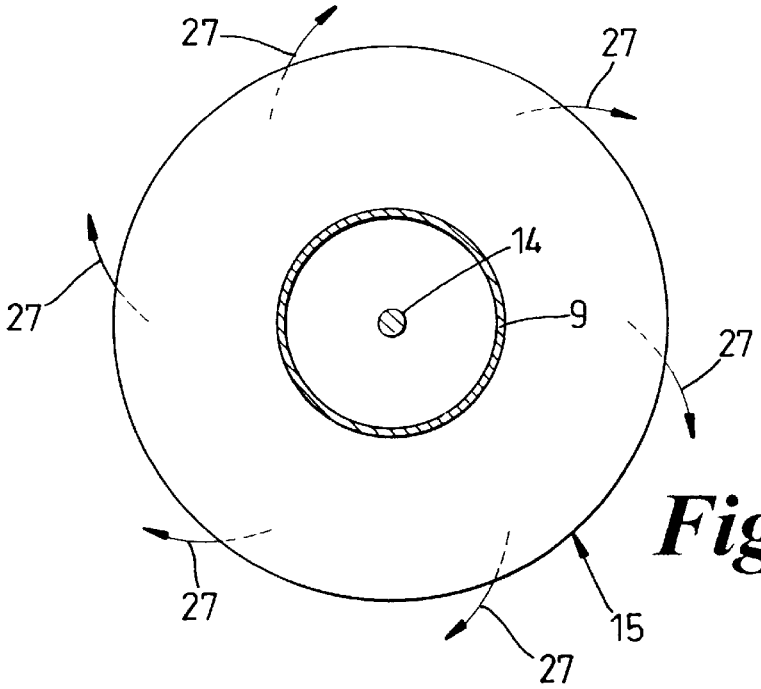
Figure 7:
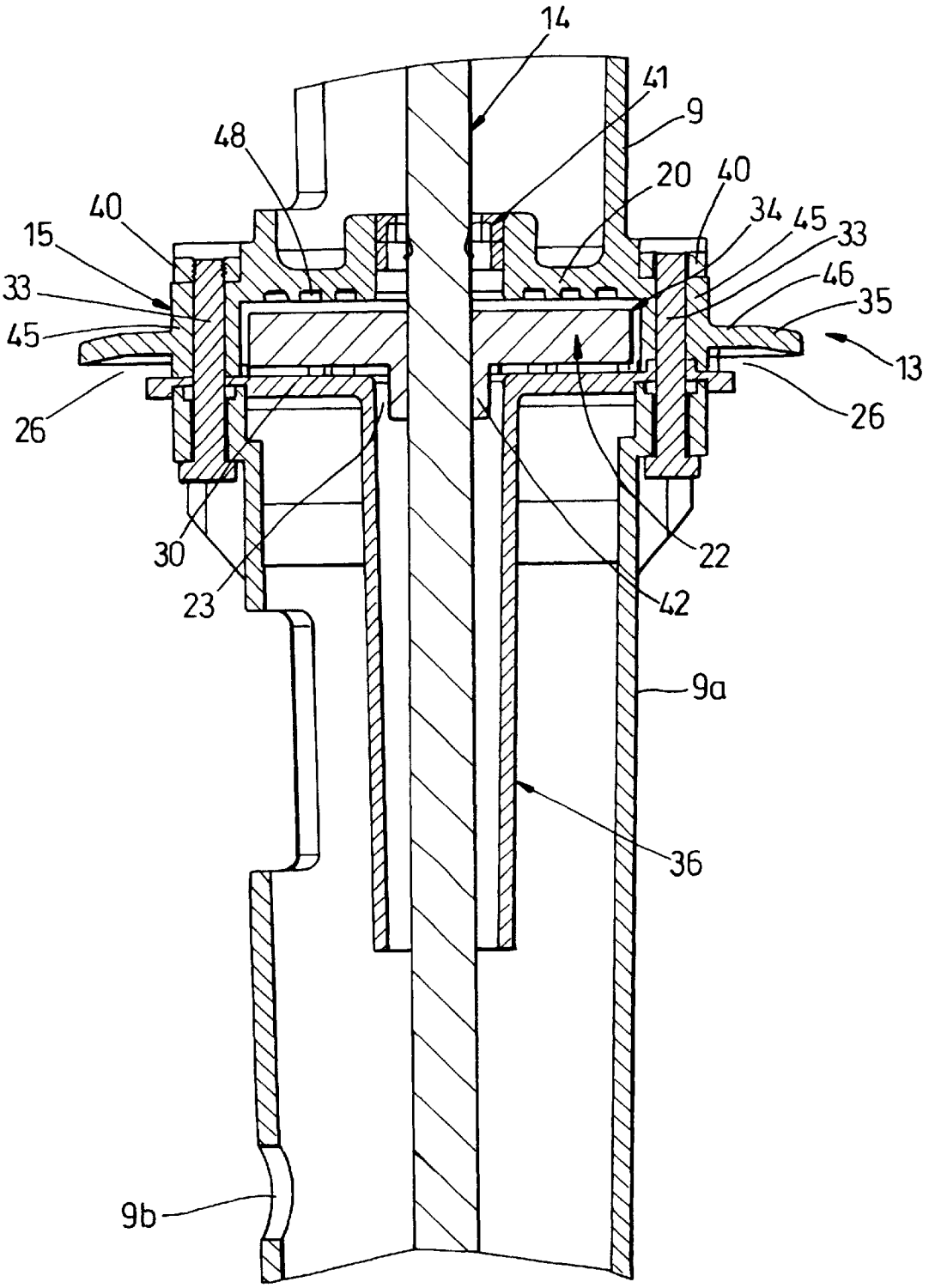
Figure 8:
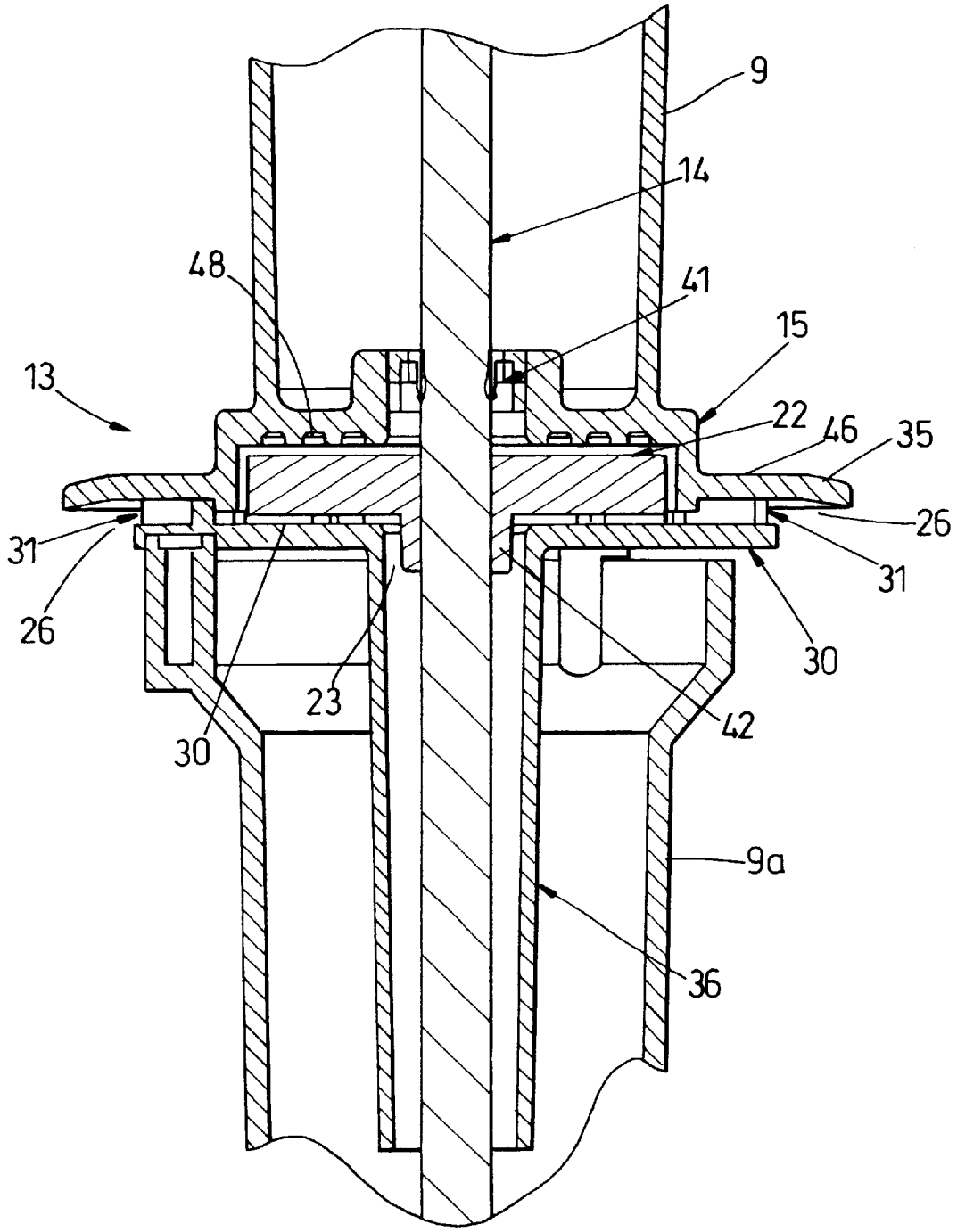
Figure 9:
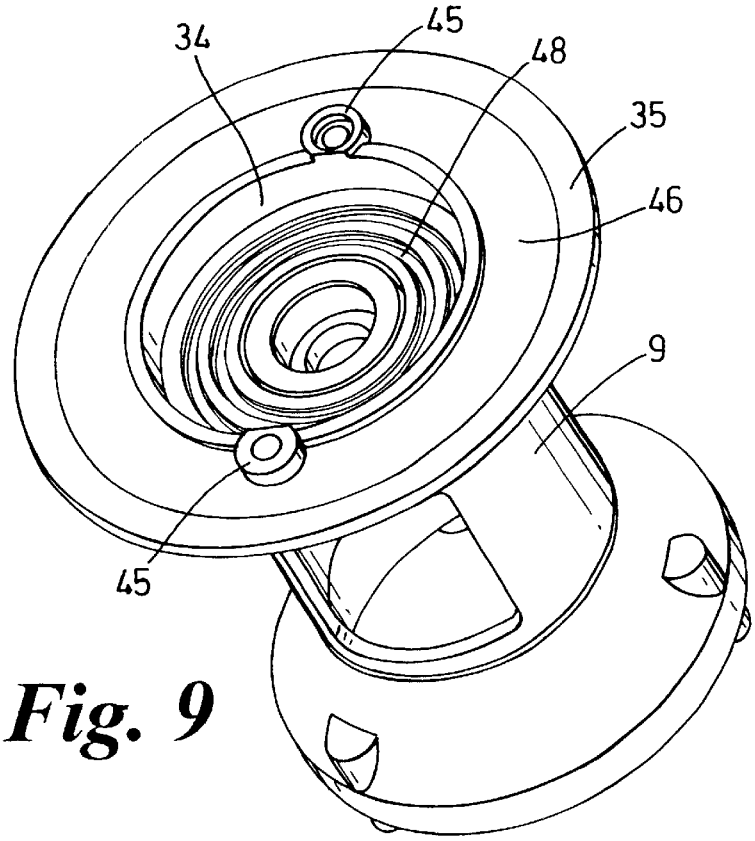
Figure 10:
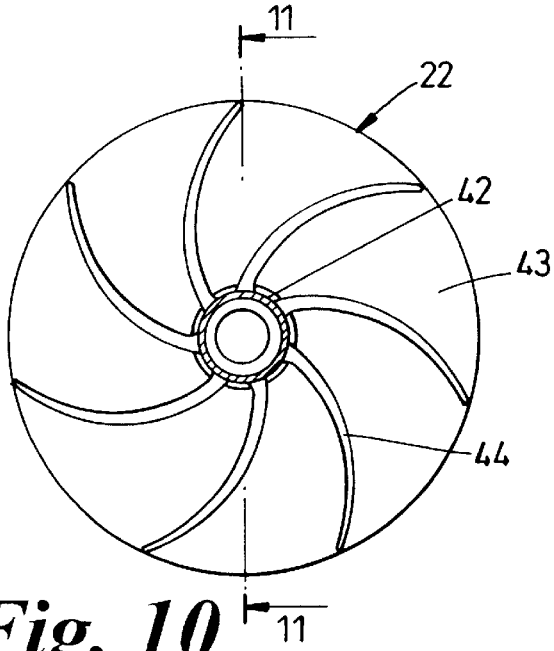
Figure 11:
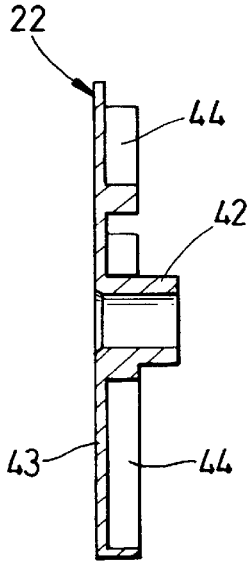
Figure 12:
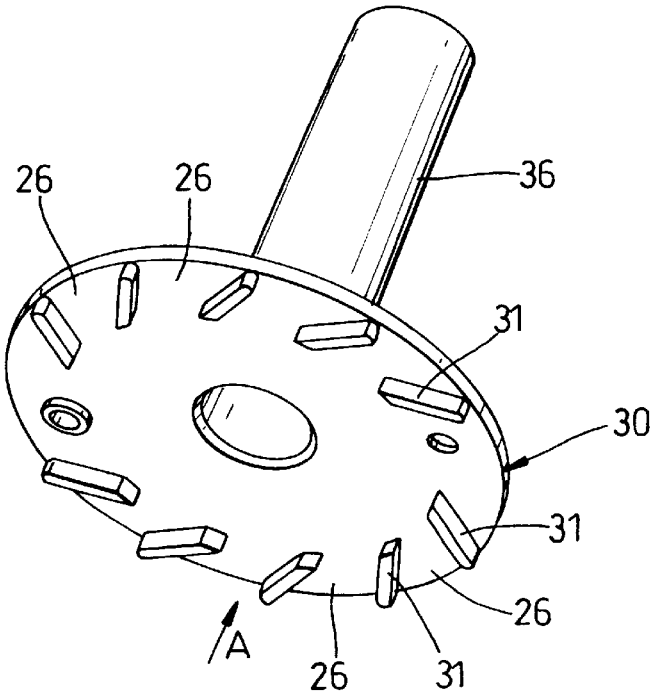
Figure 13:
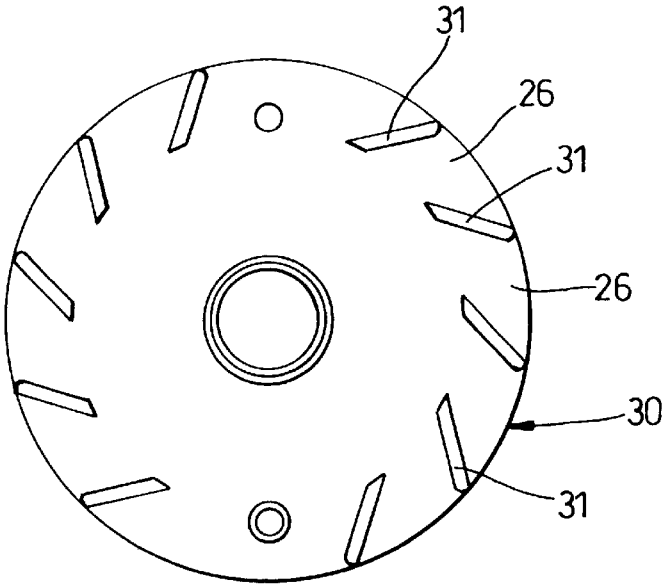

Various embodiments of the invention will now be described, by way of example only, with reference to the accompanying drawings, in which:

FIG. 1 is a schematic vertical cross-sectional view of a prior art ice bank chiller, FIG. 2 is a schematic vertical cross-sectional view of an ice bank chiller in accordance with the invention, FIG. 3 is a view similar to FIG. 2 but of a modified unit in accordance with the invention in which a pump for chilled water is positioned vertically between an agitation pump and an agitator paddle, FIG. 4 is a view similar to FIG. 2 but of a further modification in accordance with the invention and incorporating two chilled water pumps in the drive train between the agitation pump and the agitator paddle, FIG. 5 is a side elevation, partly in vertical cross-section of an agitation assembly in accordance with the invention, the assembly being a modification of the agitation assembly shown in the chiller of FIG. 2, FIG. 6 is a section on the line 6—6 of FIG. 5, FIG. 7 is a partial vertical cross-section of an agitation pump assembly in accordance with the invention, and based on the configuration of FIG. 3, the section being taken in a plane which includes a pair of housing securing screws, FIG. 8 is a vertical cross-section of the pump assembly of FIG. 7 but taken on a vertical plane transverse to the plane of FIG. 7, FIG. 9 is an underside perspective view of the upper agitation pump housing and integral upper column unit of the pump assembly of FIG. 7, FIG. 10 is an underplan view of the pump impeller of the pump assembly of FIG. 7, FIG. 11 is a section on the line 11—11 of FIG. 10, FIG. 12 is a perspective view from above of the pump housing end cap and integral water inlet tube of the pump assembly of FIG. 7, and FIG. 13 is a plan view of the end cap, looking in the direction of the arrow A in FIG. 12.

With reference to FIG. 1, a prior art ice bank chiller comprises a reservoir 1 housing vertically extending cooling coils 2 positioned adjacent to the vertical reservoir walls 3, the coils 2 being connected, by connections not shown, to a refrigerator circuit. An ice bank 4 has built up on the cooling coils 2 from water 5 contained in the reservoir, the water surface being indicated at 5*a*.

A chilled water pump 6 is mounted at the mid-height of the reservoir to supply chilled water from the water 5 held in the reservoir to an outlet tube 7 which is bundled as a python, not shown, with a series of beverage supply tubes through which beverage is supplied to beverage dispensing outlets, not shown. The chilled water return tube 7' from the python leads as shown into the upper region of reservoir 1.

The pump 6 is mounted on the lower end of support column 9, the upper end of which is secured to reservoir cover 11. Pump 6 and a paddle agitator 8 mounted below the pump 6 are driven, through a common drive shaft 14 extending within support column 9, by a motor 10 mounted on reservoir cover 11.

A problem with the prior art arrangement of FIG. 1 is that the ice bank 4 tends to be substantially thicker in the upper regions 12 thereof, which has the effect of substantially reducing the heat transfer between the upper coils of said coils 2 and the water 5. This places demands on the refrigeration circuit connected to coils 2.

In FIG. 2 parts corresponding to those of the chiller of FIG. 1 have been given corresponding reference numerals.

The chiller of FIG. 2 is in accordance with the invention and employs two agitation means, an upper agitation means in the form of an agitation pump 13, and a lower agitation means in the form of a paddle 8, driven by a common vertical drive shaft 14 from motor 10.

The agitation pump 13 is shown in more detail in the assembly of FIG. 5, and comprises an agitation pump housing 15 of cylindrical shape but of shallow depth, comprising an upper, annular housing wall 20, and a lower substantially circular housing wall 21, and a discshaped pump impeller 22, shown in outline only. The pump housing 15 is carried by the lower end of column 9 attached to reservoir cover plate 11.

A central hole 23 in lower housing wall 21 permits the lower end of drive shaft 14 to protrude, and defines a water inlet to the agitation pump. The cylindrical side-wall 25 of the pump housing 15 is formed with a series of circumferentially spaced-apart slots 26 through which water streams are expelled on rotation of the impeller 22.

The impeller and the slots 26 are shaped to expel the streams of water at acute angles to the radial direction, as shown by arrows 27 in FIG. 6, that is, in directions having a circumferential component of direction as well as a radial component. The effect is to produce a swirling flow of water adjacent to the upper part 12 of the ice bank, thereby to erode the upper part 12 of the ice bank.

Agitator 8 will, in conventional manner, circulate water in the mid and lower region 12' of the ice bank 4.

The effect of using upper and lower agitation means 13, 8 on the ice bank is indicated schematically in FIG. 2, the ice bank 4 being of substantially constant radial thickness throughout the height of the ice bank.

In the embodiment of FIG. 2, an external pump would be provided for the chilled water, and suitable chilled water outlet and return hoses would extend into the water 5 contained in reservoir 1.

In FIGS. 3 and 4 parts corresponding to the assemblies of FIGS. 1 and 2 have been given corresponding reference numbers.

The FIG. 3 assembly is similar to that of FIG. 2 except that a pump 6 for chilled water is mounted on a column 9*a* in a position vertically between the agitation pump 13 and the paddle agitator 8, all being driven by motor 10.

FIG. 4 shows yet a further modified assembly in accordance with the invention in which a pair of chilled water pumps 6' and 6" are mounted one beneath the other to supply chilled water to two chilled water outlet tubes 30, 31 respectively. This arrangement is in accordance with our co-pending patent application GB 9905664.0 filed Dec. 3,1999. The agitation pump 13, chilled water pumps 6' and 6" and the paddle agitator 8 are all driven through common shaft 14 by the motor 10.

FIGS. 7 to 12 show a modified agitation pump assembly. Parts corresponding to those of the assemblies of the previous figures have been given corresponding numerals.

The pump assembly of FIGS. 7 to 12 essentially has the configuration of FIG. 3 except that the column 9*a* is longer, and the inlet to the agitation pump is defined by a tube 36.

The housing 15 carries a removable end cap 30, FIGS. 12, 13 which is provided on the upperside thereof with a series of circumferentially spaced-apart vanes 31 which are each inclined to the local radial direction of end cap 30 to define inclined water outlet slots 26, so as to cause water issuing from slots 26 to swirl about the vertical axis of the drive shaft 14, in the manner indicated in FIG. 6 by arrows 27.

End cap 30 is mounted on the housing 15 by a pair of diametrically opposed screws 33 extending through respective bosses 45 and engaged with nuts 40. The impeller 22, shown in detail in FIGS. 10 and 11, is received in a circular recess 34, FIG. 9, in housing 15.

An inclined skirt 35 directs the water streams issuing from outlet slots 26 in a downwards and outwards direction, to cause the swirling water to descend down the ice bank, in order to erode the ice bank 4.

Although a paddle agitator 8 may be provided on the lower end of shaft 14, as in FIG. 3, this may not always be necessary.

The tube 36 is provided to cause the water ingested through opening 23 to be taken from the lower regions of the reservoir 5 by way of a hole 9*b* in the lower part of column 9*a*, in order to promote circulation at depth in reservoir 1.

A shaft seal assembly 41 is provided to resist ingress of water into the pump along shaft 14. As shown in FIG. 9 the upper wall 20 of the pump housing is provided with three co-axial annular recesses 48 which assist in reducing the radial pressure gradient across the upper wall 20, thereby to reduce the pressure differential to which seal assembly 41 is exposed.

As shown in FIGS. 10 and 11 impeller 22 comprises an integral impeller hub 42, disc 43 and spiral vanes 44 beneath disc 43, the impeller being indicated schematically in FIGS. 7 and 8.

The external diameter of the impeller 22 is such that the disc 43 fits with clearance radially inside the vanes 31 provided on end cap 30. As shown in FIG. 8, the vanes 31 on end cap 30 abut with the root 46 of flange 35 when the screws 33 are tightened to secure end plate 30 against the bosses 45.

What is claimed is:

1. An ice bank chiller comprising a reservoir having a side wall and a base wall for containing reservoir water, vertically distributed cooling means positioned above said base and adjacent to said side wall, said cooling means comprising upper and lower regions of said cooling means, and said cooling means maintaining in use an ice bank on said upper and lower regions, and agitation means for agitating, in use, water contained in said reservoir, wherein said agitation means is so arranged as, in use, to cause substantial circulation of said reservoir water adjacent to said ice on both said upper and lower regions of said cooling means, wherein said agitation means comprises an agitation pump so arranged as to direct a plurality of streams of water towards said cooling means, wherein said agitation pump comprises an impeller rotatable within a pump housing, said housing being provided with a plurality of circumferentially spaced-apart pump outlets, whereby in use, on rotation of said impeller in a forward direction, said streams of water are directed from said outlets towards said ice on said cooling means.

2. A chiller as claimed in claim 1 wherein said agitation pump is arranged to direct said streams of water with a circumferential component of direction, that is the streams of water are directed at an acute angle relative to a radial direction of said pump, so as to create a swirling movement in water that is radially exterior to said agitation pump housing.

3. A chiller as claimed in claim 1 wherein said agitation pump housing is formed with a substantially axial water inlet which is directed downwardly of said reservoir.

4. A chiller as claimed in claim 3 in which said pump housing is provided with a downwardly directed tube feeding said inlet, said tube being so arranged as, in use, to collect water from lower regions of the reservoir.

5. An ice bank chiller comprising a reservoir having a side wall and a base wall for containing reservoir water, vertically distributed cooling means positioned above said base and adjacent to said side wall, said cooling means comprising upper and lower regions of said cooling means, and said cooling means maintaining in use an ice bank on said upper and lower regions, and agitation means for agitating, in use, water contained in said reservoir, wherein said agitation means is so arranged as, in use, to cause substantial circulation of said reservoir water adjacent to said ice on both said upper and lower regions of said cooling means, wherein said agitation means comprises an agitation pump so arranged as to direct a plurality of streams of water towards said cooling means, wherein said agitation pump comprises a pump housing, wherein said agitation pump housing is provided with a downwardly inclined skirt for directing said streams of water in a downwards and outwards direction relative to said pump housing.

6. An ice bank chiller comprising a reservoir having a side wall and a base wall for containing reservoir water, vertically distributed cooling means positioned above said base and adjacent to said side wall, said cooling means comprising upper and lower regions of said cooling means, and said cooling means maintaining in use an ice bank on said upper and lower regions, and agitation means for agitating, in use, water contained in said reservoir, wherein said agitation means is so arranged as, in use, to cause substantial circulation of said reservoir water adjacent to said ice on both said upper and lower regions of said cooling means, wherein said agitation means comprises an agitation pump so arranged as to direct a plurality of streams of water towards said cooling means, wherein said agitation means comprises vertically spaced-apart upper and lower agitation means.

7. A chiller as claimed in claim 6 wherein said upper and lower agitation means are driven by a common drive means.

8. A chiller as claimed in claim 7 wherein said common drive means comprises a substantially vertical shaft driven by a motor mounted above said reservoir.

9. A chiller as claimed claim 6, wherein said agitation pump constitutes said upper agitation means located in the upper part of said reservoir.

10. A chiller as claimed in claim 9 wherein said lower agitation means comprises a rotatable paddle.

11. A chiller as claimed claim 6 wherein said pump for supplying the chilled water is driven by the same drive means that is arranged to drive said first and second agitation means.

12. A chiller as claimed in claim 11 wherein said pump is positioned vertically between said first and second agitation means.

* * * * *